US008240491B2

(12) United States Patent
Beecroft et al.

(10) Patent No.: US 8,240,491 B2
(45) Date of Patent: Aug. 14, 2012

(54) CHILD-RESISTANT CANISTER

(75) Inventors: W. Gordon Beecroft, Leola, PA (US); Chad E. Rice, Lititz, PA (US); Duane C. Sawyer, York, PA (US); John A. Vassallo, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 411 days.

(21) Appl. No.: 12/553,818

(22) Filed: Sep. 3, 2009

(65) Prior Publication Data

US 2010/0051572 A1 Mar. 4, 2010

Related U.S. Application Data

(60) Provisional application No. 61/093,964, filed on Sep. 3, 2008.

(51) Int. Cl.
*B65D 55/02* (2006.01)
*B65D 41/04* (2006.01)

(52) U.S. Cl. ..... 215/216; 215/219; 215/221; 215/222; 215/330; 220/293; 220/300; 220/301

(58) Field of Classification Search ..... 215/216, 215/219, 221, 222, 224, 330; 220/214, 293, 220/300, 301
See application file for complete search history.

(56) References Cited

U.S. PATENT DOCUMENTS

| | | | | |
|---|---|---|---|---|
| 3,888,375 | A | 6/1975 | Gerk | |
| 3,917,097 | A | 11/1975 | Uhlig | |
| 3,941,268 | A | 3/1976 | Owens et al. | |
| 3,984,021 | A | 10/1976 | Uhlig | |
| 3,989,152 | A | 11/1976 | Julian | |
| 3,993,208 | A | 11/1976 | Ostrowsky | |
| 4,149,646 | A | 4/1979 | Julian | |
| 4,752,013 | A | 6/1988 | Miller et al. | |
| 4,752,014 | A | 6/1988 | House et al. | |
| 4,948,002 | A | 8/1990 | Thornock et al. | |
| 5,038,454 | A | 8/1991 | Thornock et al. | |
| D330,677 | S | 11/1992 | Thornock et al. | |
| 5,230,433 | A | 7/1993 | Hamilton et al. | |
| 5,383,564 | A | 1/1995 | Hamilton et al. | |
| 5,413,233 | A | 5/1995 | Hall | |
| 5,449,077 | A | 9/1995 | Seidler | |
| 5,460,281 | A | 10/1995 | Rapchak et al. | |
| 5,462,182 | A | 10/1995 | Opresco | |
| 5,671,853 | A | 9/1997 | Herr | |
| 5,921,417 | A * | 7/1999 | Mull | 215/216 |
| 5,927,526 | A | 7/1999 | Herr | |
| 2007/0194047 | A1 | 8/2007 | Tauber et al. | |

FOREIGN PATENT DOCUMENTS

| | | |
|---|---|---|
| CA | 2001079 | 4/1990 |

* cited by examiner

*Primary Examiner* — Anthony Stashick
*Assistant Examiner* — Madison L Wright
(74) *Attorney, Agent, or Firm* — Barnes & Thornburg LLP

(57) ABSTRACT

A child-resistant canister includes a container and a closure configured to mount on the container to close an opening into an interior region formed in the container. The closure includes a lid and a lid anchor coupled to the lid. The lid anchor is configured to mate with a closure retainer included in the container to retain the closure in a mounted position on the container.

20 Claims, 4 Drawing Sheets

CHILD-RESISTANT CANISTER

This application claims priority under 35 U.S.C. §119(e) to U.S. Provisional Application Ser. No. 61/093,964, filed Sep. 3, 2008, which is expressly incorporated by reference herein.

BACKGROUND

The present disclosure relates to a canister, and particularly to a canister including a container and a removable closure. More particularly, the present disclosure relates to a child-resistant canister.

SUMMARY

According to the present disclosure, a child-resistant canister includes a container and a closure configured to mount on the container to close an opening into an interior region formed in the container. The closure includes a lid and a lid anchor coupled to the lid. The lid anchor is configured to mate with a closure retainer included in the container to retain the closure in an installed position on the container.

In illustrative embodiments, the container includes a filler neck and a closure retainer coupled to a cylindrical exterior surface of the filler neck. The lid anchor includes a lug support coupled to a top wall of the lid and first and second anchor lugs coupled to the lug support and arranged to mate with the closure retainer during installation of the closure on the filler neck of the container.

In illustrative embodiments, the closure retainer includes a series of rail sections. One group of the rail sections cooperate to form a first lug-retainer notch and guide the first anchor lug in horizontal and inclined directions into the first lug-retainer notch during rotation of the closure about an axis of rotation in a closure-installation direction relative to the container to assume an installed position on the container. A second group of the rail sections cooperate to form a second lug-retainer notch and guide the second anchor lug in horizontal and inclined directions into the second lug-retainer notch during movement of the first anchor lug into the first lug-retainer notch.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 5 shows downward movement of the first and second anchor lugs into neighboring inclined lug-receiver slots formed between some of the rail sections as the closure is rotated in a clockwise direction about a vertical axis of rotation toward an installed position on the container;

FIG. 6 shows further downward movement of the first and second anchor lugs out of the inclined lug-receiver slots and into the companion first and second lug-retainer notches in response to continued rotation of the closure in the clockwise direction about the vertical axis of rotation;

FIG. 7 shows deployment of the first anchor lug in the companion first lug-retainer notch in response to further clockwise rotation of the closure about the vertical axis of rotation to establish the installed position of the closure on the filler neck of the container;

DETAILED DESCRIPTION

Figures 1, 2:
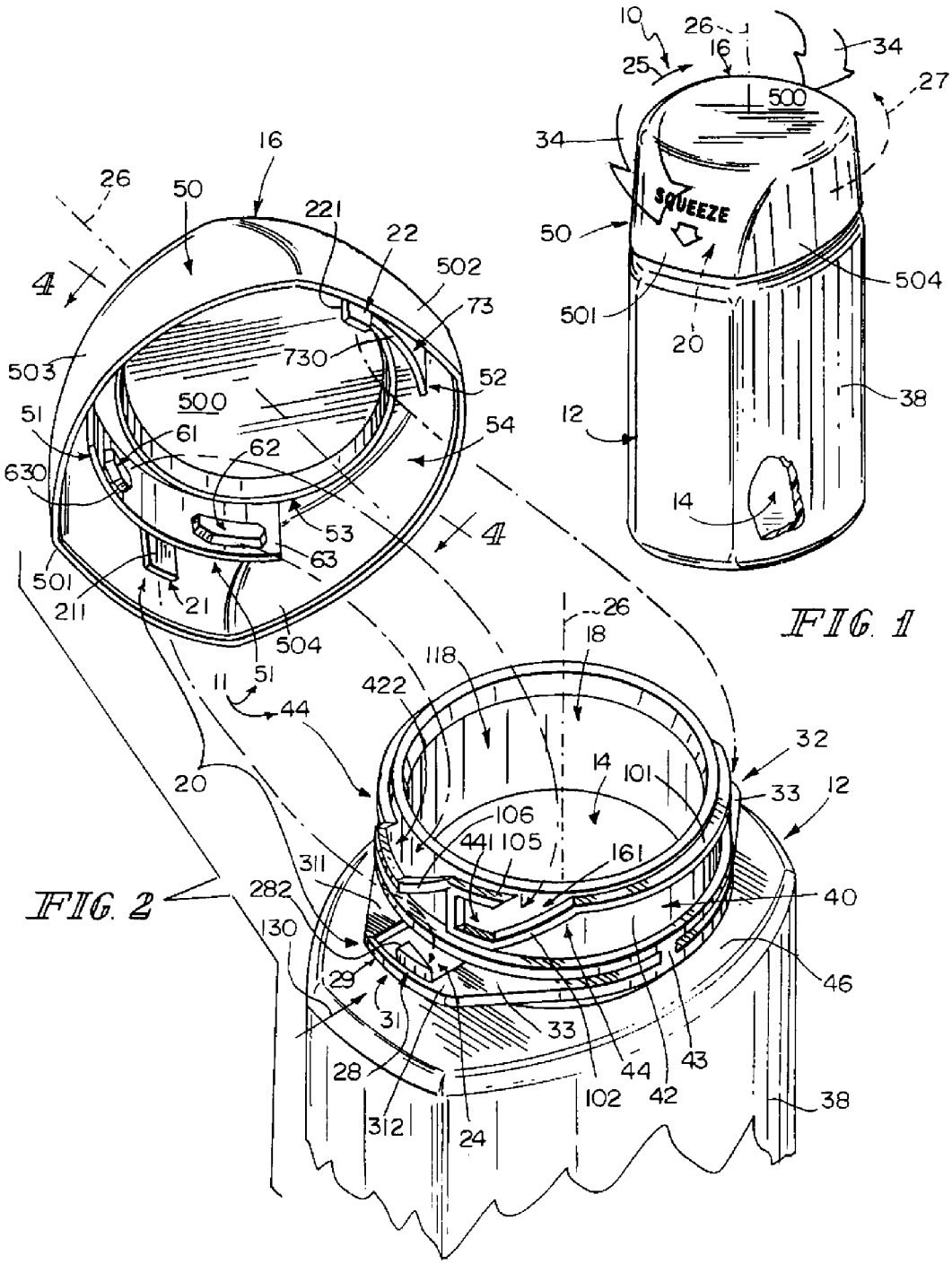
FIG. 1 is a perspective view of a child-resistant canister in accordance with the present disclosure showing a closure mounted on an underlying container and suggesting that an adult user can apply a squeezing pressure (represented by two double arrows) to front and rear sides of the closure to disable a child-resistant closure-release control mechanism provided in the canister so that the closure is free to rotate in a counterclockwise closure-removal direction (represented by a phantom arrow) from the installed position shown in FIGS. 1 and 7 toward an opened position.
FIG. 2 is an enlarged perspective assembly view of the canister of FIG. 1 showing the closure before it is installed on the container of FIG. 1 and showing that the container includes a filler neck having a cylindrical rim and a closure retainer comprising a series of rail sections coupled to an exterior surface of the cylindrical rim and suggesting that anchor lugs included in the closure are sized to ride on the rail sections and fit into companion lug-retainer notches defined by the rail sections when the closure is mounted on the filler neck of the underlying container as suggested in FIGS. 5-7.
Figure 6:
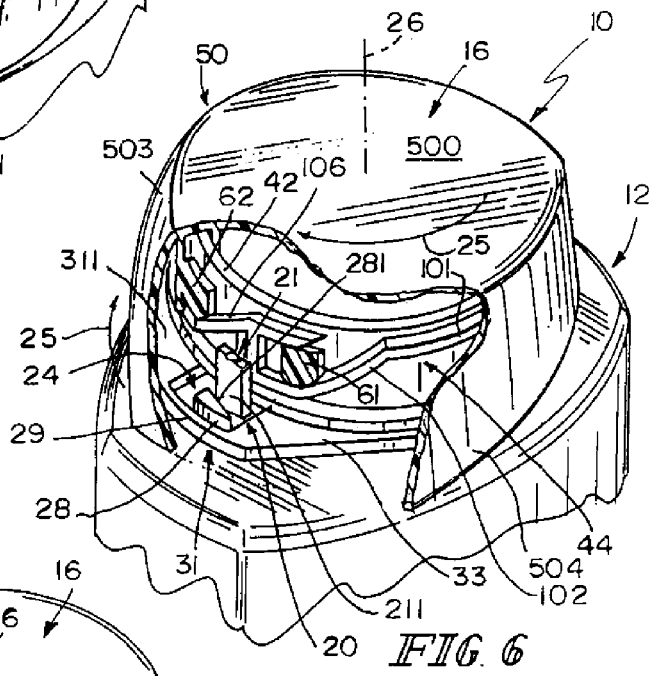
Figure 7:
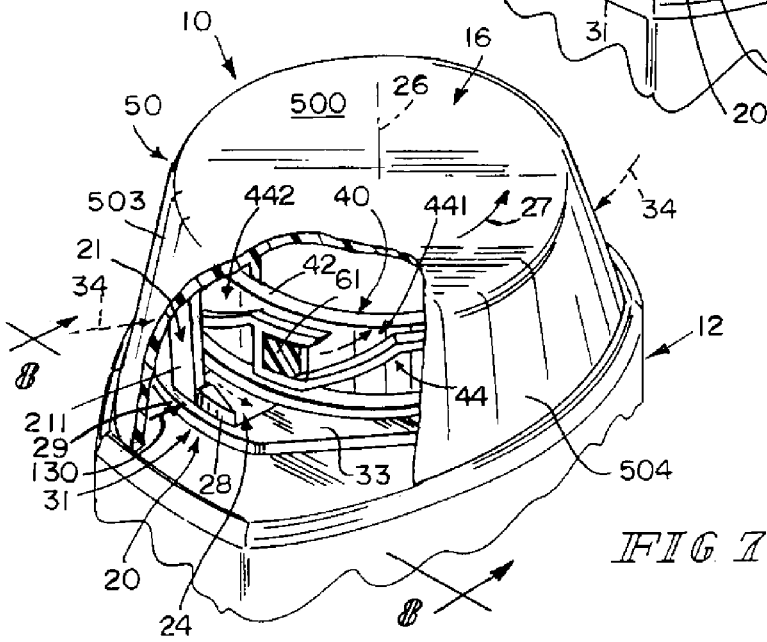

A canister 10 includes a container 12 formed to include a product-receiving chamber 14 and a removable closure 16 configured to mount on top of container 12 and cover open mouth 18 of container 12 as suggested in FIGS. 1, 2, and 7. Closure 16 includes a lid 50 and lid anchors 51, 52 that are coupled to lid 50 as suggested illustratively in FIGS. 2 and 3 and diagrammatically in FIG. 8. Lid anchors 51, 52 are configured to mate with a closure retainer 44 included in container 12 to retain closure 16 in an installed position on container 12 as suggested in FIGS. 1, 7, and 9. Closure retainer 44 and one or more of lid anchors 51, 52 cooperate to provide anchor means 11 for retaining lid 50 in a stationary position mounted on container 12 in response to rotation of closure 16 about an axis of rotation 26 in a closure-installation direction 25 as suggested in FIGS. 1, 2, and 5-9.

Canister 10, in an illustrative embodiment, also includes a child-resistant closure-release control mechanism 20 comprising a first lock tab 21 coupled to closure 16 and a companion first tab controller 31 coupled to container 12. First tab controller 31 is configured to mate with first lock tab 21 as suggested in FIGS. 2 and 7 so that unauthorized removal of closure 16 from container 12 by young children is blocked. It is within the scope of this disclosure to provide a canister 10 with anchor means 11 and without child-resistant closure-release control mechanism 20.

Container 12 includes a body 38 and a filler neck 40 coupled to body 38 as shown, for example, in FIG. 2. Filler neck 40 is formed to include a passageway 118 communicating with mouth 18 and opening into product-receiving chamber 14 formed in body 38 as suggested in FIG. 2. Filler neck 40 includes a cylindrical rim 42 coupled to body 38 and a closure retainer 44 coupled to rim 42.

Rim 42 of filler neck 40 is arranged to extend upwardly from body 38 and terminate at mouth 18 as suggested in FIG. 2. Rim 42 is arranged to lie in a space provided under lid 50 and between the spaced-apart downwardly extending lid anchors 51, 52 as suggested in FIG. 2 when closure 16 is mounted on container 12.

Figure 8:
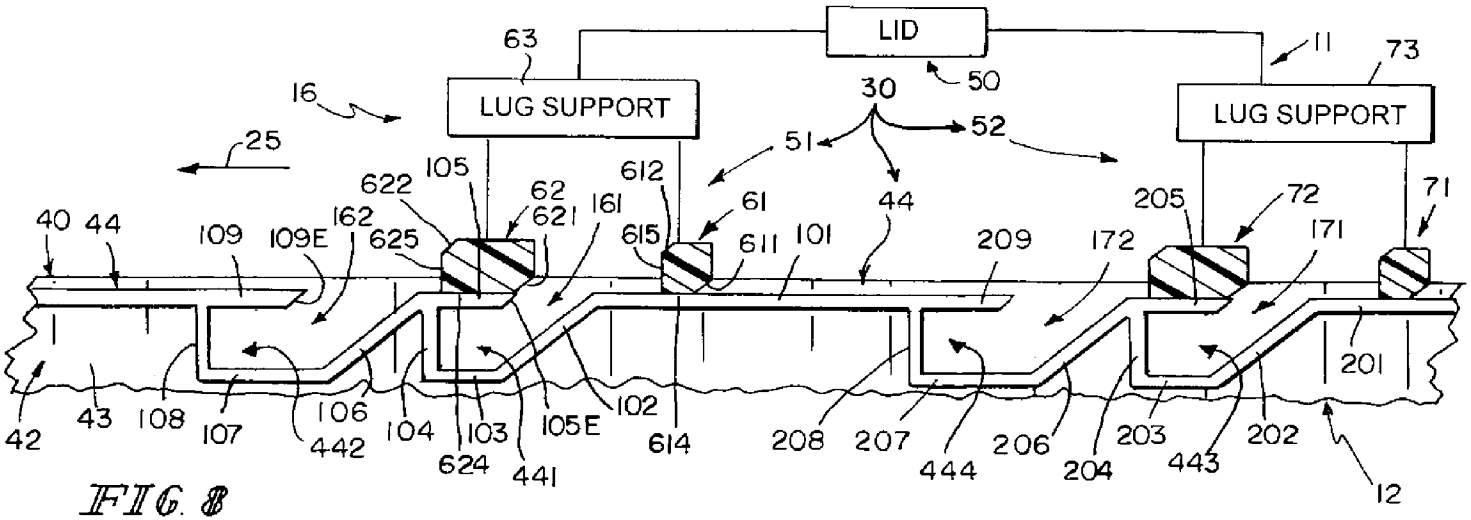
FIG. 8 is an enlarged flat development of the cylindrical rim included in the filler neck of the container of FIG. 2 showing the rail sections included in the closure retainer that is coupled to the cylindrical rim and showing (on the left) a first closure mount comprising (in section) second and first anchor lugs (included in the curved first lid anchor) riding on horizontal rail sections and nearing side-by-side empty second and first anchor retainer notches and (on the right) a second closure mount comprising (in section) second and first anchor lugs (included in the curved second lid anchor) riding on other horizontal rail sections and nearing another set of side-by-side empty fourth and third lug-retainer notches.
Figure 9:
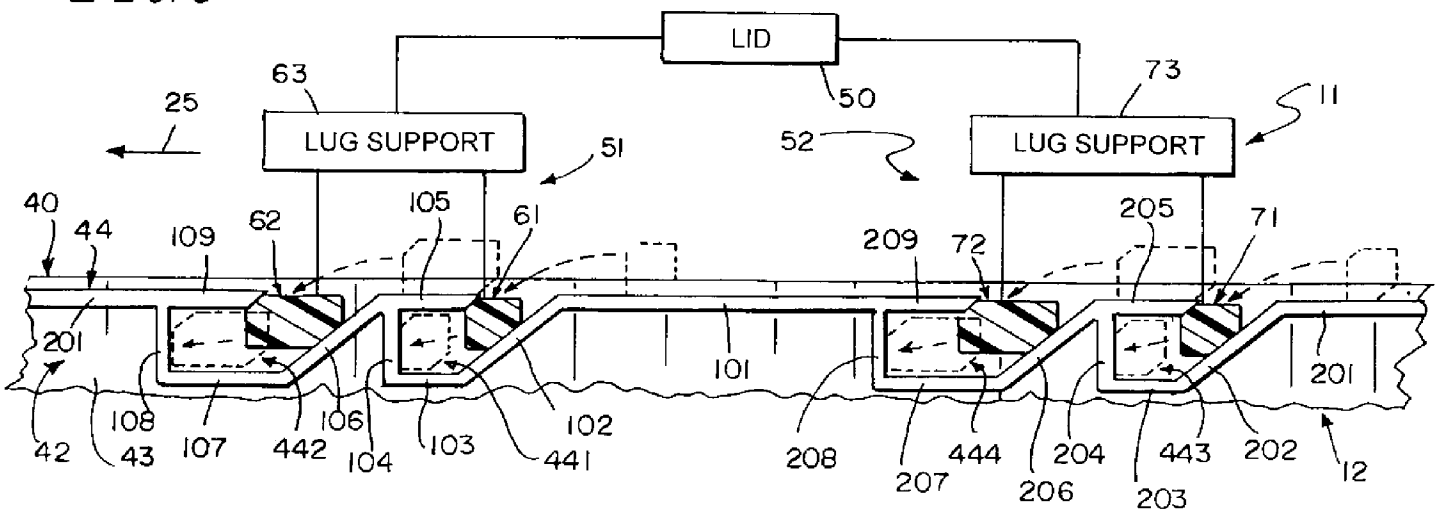
FIG. 9 is similar to FIG. 8 showing (on the left) movement of the anchor lugs in the first closure mount through companion inclined lug-receiver slots toward the companion lug-retainer notches and (on the right) movement of the anchor lugs in the second closure mount through companion inclined lug-receiver slots toward companion lug-retainer notches.

Closure retainer 44 is configured to mate with lid anchors 51, 52 closure 16 to retain closure 16 in an installed position on container 12 as suggested illustratively in FIG. 7 and diagrammatically in FIG. 9. Closure retainer 44 is coupled to exterior surface 43 of rim 42 and is arranged to lie outside of passageway 118 in the illustrated embodiment as suggested in FIG. 2. Closure retainer 44 comprises a series of rail sections 101-109 and 201-209 as shown, for example, in FIGS. 2, 8, and 9. Closure retainer 44 and rim 42 cooperate to form a monolithic element in the illustrated embodiment.

Figure 3:
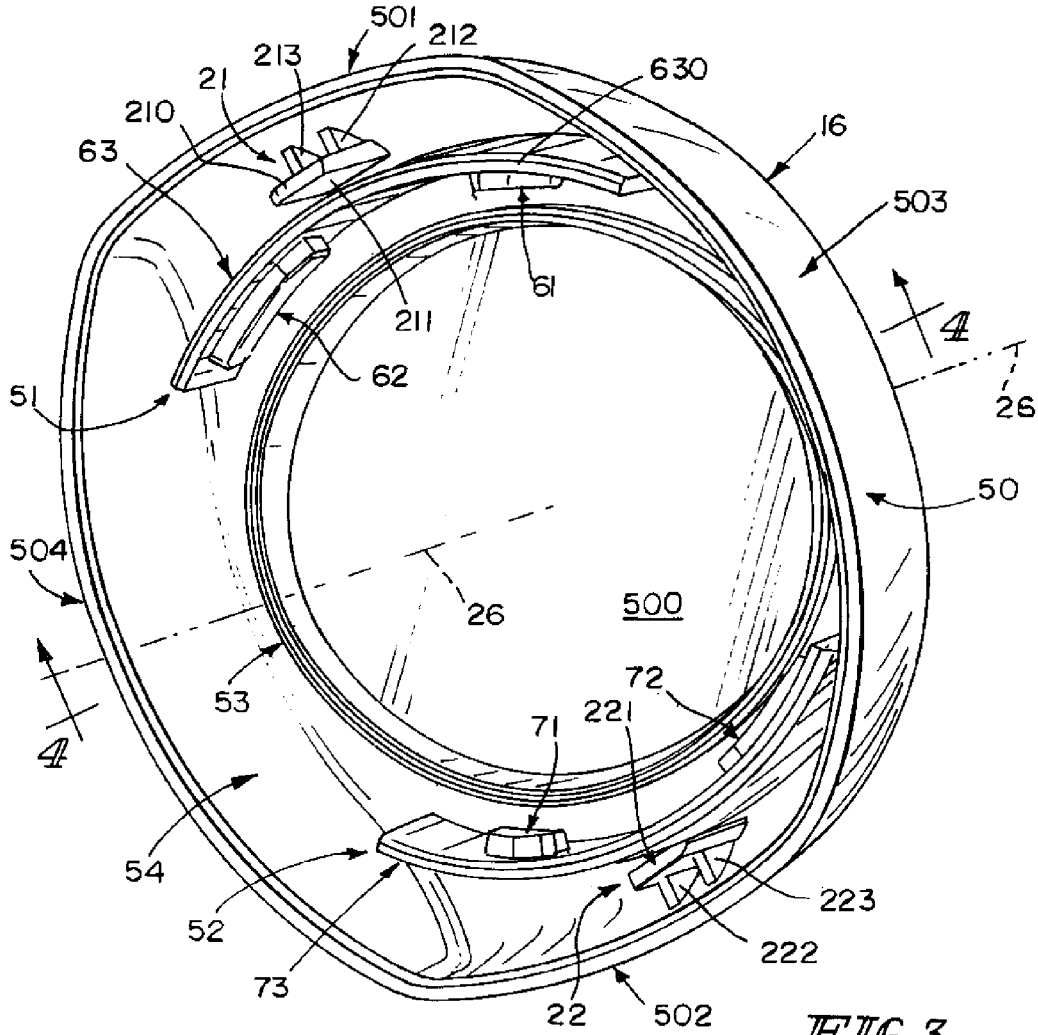
FIG. 3 is an enlarged perspective view of the underside of the closure of FIGS. 1 and 2 showing that the closure includes a lid comprising a top wall, two longer bowed side walls, and two shorter bowed tab-mover walls, a first child-resistant lock tab included in the closure-release control mechanism is coupled to the bowed tab-mover wall in the upper part of FIG. 3, and a second child-resistant lock tab included in the closure-release control mechanism is coupled to the bowed tab-mover wall in the lower part of FIG. 3 and showing that the closure further includes a curved first lid anchor located in close proximity to the first child-resistant lock tab and a curved second lid anchor located in close proximity to the second child-resistant lock tab and spaced-apart relation to the curved first lid anchor.
Figure 4:
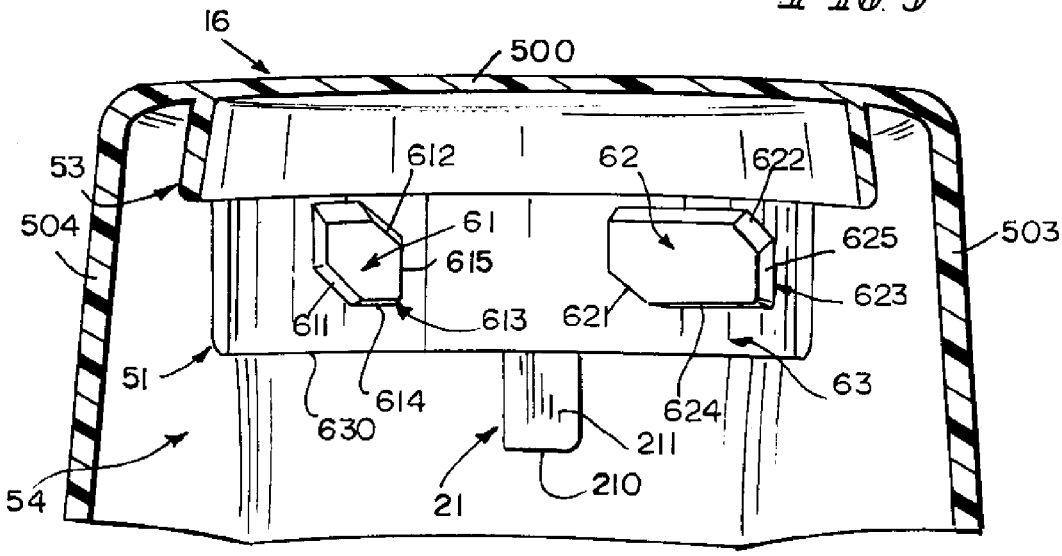
FIG. 4 is an enlarged sectional view taken along line 4-4 of FIG. 3 showing that the curved first lid anchor includes a short first anchor lug and a longer second anchor lug coupled to a curved lug support and showing a portion of the first lock tab extending downwardly below a lower edge of the curved lug support.

Closure 16 includes a lid 50, a first lid anchor 51, a second lid anchor 52, and a ring-shaped orientation member 53 located between first and second lid anchors 51, 52 as shown, for example, in FIGS. 2-4. First lid anchor 51 is configured to mate with rail sections 101-109 of closure retainer 44 during installation of closure 16 on container 12 as suggested in FIG. 2 and FIGS. 5-7 to retain lid 50 in a mounted position on filler neck 40 closing open mouth 18 of container 12. Second lid anchor 52 is configured to mate with rail sections 201-209 of closure retainer 44 provided on filler neck 40 as suggested in FIGS. 2, 8, and 9. First lock tab 21 is coupled to lid 50 and arranged to lie in an interior region 54 formed in lid 50 as suggested in FIGS. 2-4.

Lid 50 includes a top wall 500 and first and second tab-mover walls 501, 502 coupled to top wall 500 and arranged to lie in spaced-apart relation to one another as shown in FIGS. 2 and 3. Lid 50 also includes two side walls 503, 504 coupled to top wall 500 and to first and second tab-mover walls 501, 502. Side walls 503, 504 are arranged to lie in spaced-apart relation to one another as suggested in FIGS. 2 and 3. In the illustrated embodiment, each of side walls 503, 504 is bowed and each of tab-mover walls 501, 502 is relatively shorter in length than each of the two side walls 503, 504. Walls 501, 502, 503, and 504 cooperate to form a skirt coupled to top wall 50 of lid 50 and configured to form interior region 54 of lid 50.

Closure retainer 44 comprises a first series of rail sections 101-109 coupled to exterior surface 43 of filler neck 40 and configured to form a first lug-retainer notch 441 and a separate second lug-retainer notch 442 on exterior surface 43 of filler neck 40 as suggested in FIG. 2. First and second lug-retainer notches 441, 442 are arranged to lie in side-by-side relation to one another as suggested in FIGS. 2 and 8.

First lid anchor 51 includes a lug support 63 and first and second anchor lugs 61, 62 as shown, for example, in FIGS. 2-4, 8, and 9. Lug support 63 is coupled to lid 50 and arranged to lie in interior region 54 of lid 50.

First anchor lugs 61 is coupled to lug support 63 and arranged to extend toward axis of rotation 26 and into first anchor-retainer notch 441 when closure 16 lies in the installed position on container 12 as suggested in FIGS. 2, 7, and 9. Second anchor lug 62 is coupled to lug support 63 and arranged to extend toward axis of rotation 26 and into second anchor-retainer notch 442 when closure 16 lies in the installed position on container 12 as suggested in FIGS. 2 and 9. First anchor lug 61 is short in length and second anchor lug 62 is relatively longer than lug 61 in the illustrated embodiment. Each of lugs 61, 62 is arranged to extend from lug support 63 in radially inward directions toward axis of rotation 26 as suggested in FIGS. 2 and 3. Plate 211 of first lock tab 21 is arranged to extend downwardly below a lower edge 630 of lug support 63 as shown, for example, in FIG. 4.

Closure 16 further includes a ring-shaped orientation member 53 coupled to the top wall 500 of lid 50 as shown, for example, in FIGS. 2 and 3. Ring-shaped orientation member 53 is arranged to lie in interior region 54 of lid 50 to mate with rim 42 when closure 16 lies in the closed position on container 12 to orient lid 50 in a predetermined aligned relation with container 12. Ring-shaped orientation member 53 is arranged to lie between first and second lid anchors 51, 52 as suggested in FIGS. 2 and 3.

Lug support 63 is curved and has a concave surface facing toward axis of rotation 26 and a convex surface facing toward first lock tab 21 as suggested in FIG. 3. Lug support 63 is established by a curved wall anchored to interior surface 500 of lid 50 and arranged to lie in a space provided between first lock tab 21 and ring-shaped orientation member 53 as shown best in FIG. 3. Lug support 63 is arranged to lie between first lock tab 21 and axis of rotation 26. First lock tab 21 terminates at a lower edge 210 as shown, for example, in FIGS. 3 and 4. Lug support 63 terminates at a lower edge 630. Lower edge 630 of lug support 63 is arranged to lie between top wall 500 of lid 50 and lower edge 210 of first lock tab 21 as shown, for example, in FIG. 4.

Closure retainer 44 also comprises a second series of rail sections 201-209 coupled to exterior surface 43 of filler neck 40 and configured to form a third lug-retainer notch 443 and a separate fourth lug-retainer notch 444 as suggested in FIG. 8. Third and fourth lug-retainer notches 443, 444 are arranged to lie in side-by-side relation to one another as suggested in FIG. 8.

Second lid anchor 52 illustratively includes a first anchor lug 71, a second anchor lug 72, and a lug support 73 coupled to lid 50 and to lugs 71, 72 as shown, for example, in FIG. 3. Second lid anchor 52 lies in a space provided between second lock tab 22 and ring-shaped orientation member 53. First anchor lug 71 is similar in shape and function to first anchor lug 61 and extends into third lug-retainer notch 443 when closure 16 lies in the installed position on container 12. Second anchor lug 72 is similar in shape and function to second anchor lug 62 and extends into fourth lug-retainer notch 444 when closure 16 lies in the installed position on container 12. Lug support 73 is similar in shape and function to lug support 63. Plate 221 of second lock tab 22 is arranged to extend downwardly below a lower edge 730 of lug support 73 as shown, for example, in FIG. 2.

During an early-stage installation of closure 16 on container 12 as suggested in FIGS. 5-9, first and second anchor lugs 61, 62 of first lid anchor 51 lie at rest, respectively, on rail sections 101, 105 of closure retainer 44 while first and second anchor lugs 71, 72 of second lid anchor 52 lie at rest, respectively, on rail sections 201, 205 of closure retainer 44. In response to rotation of lid 50 about axis of rotation 26 in closure-installation direction 25, first anchor lug 61 moves into a companion inclined lug-receiver slot 161 defined between rail sections 102, 105, second anchor lug 62 moves into a companion inclined lug-receiver slot 162 defined between rail sections 106, 109, first anchor lug 71 moves into a companion inclined lug-receiver slot 171 defined between rail sections 202, 205, and second anchor lug 72 moves into a companion inclined lug-receiver slot 172 defined between rail sections 206, 209 as suggested in FIGS. 8 and 9.

Continued rotation of lid 50 about axis of rotation 26 in closure-installation direction 25 causes first anchor lug 61 to move into first lug-retainer notch 441, second anchor lug 62 to move into second lug-retainer notch 442, first anchor lug 71 to move into third lug-retainer notch 443, and second anchor lug 72 to move into fourth lug-retainer notch 444 as suggested in FIG. 9. Rotation of lid 50 in closure-installation direction 25 continues until one or more of anchor lugs 61, 62, 71, 72 engages a stationary companion rotation-stop rail section 104, 108, 204, 208 included in closure retainer 40 as suggested (in phantom) in FIG. 9.

As suggested in FIGS. 3 and 4, second anchor lug 62 has a relatively long length as compared to first anchor lug 61. The length of second anchor lug 62 is greater than the width of the mouth of inclined lug-receiver slot 161 to block second anchor lug 62 from entering the inclined lug-receiver slot 161 intended for the relatively shorter first anchor lug 61. Inclined lug-receiver slot 162 is wide enough to receive relatively longer second anchor lug 62 therein as suggested in FIG. 9. This configuration of companion anchor lugs and slots minimizes the opportunity for incorrect installation of closure 16 on container 12.

First anchor lug 61 includes a first chamfered edge 611, a second chamfered edge 612, and an external surface 613 interconnecting first and second chamfered edges 611, 612 and comprising a bottom edge 614 and a front edge 615 as suggested in FIGS. 4 and 8. First and second chamfered edges 611, 612 lie in spaced-apart parallel relation to one another. Bottom and front edges 614, 615 cooperate to form a right included angle therebetween. In an illustrative embodiment, bottom edge 614 interconnects first chamfered edge 611 and front edge 615 and front edge 615 interconnects bottom edge 614 and second chamfered edge 612. First anchor lug 71 has a size and shape that is similar to first anchor lug 61.

Second anchor lug 62 includes a first chamfered edge 621, a second chambered edge 622, and an external surface 623 interconnecting first and second chamfered edges 621, 622 and comprising a bottom edge 624 and a front edge 625 as suggested in FIGS. 4 and 8. First and second chamfered edges 621, 622 lie in spaced-apart parallel relation to one another. Bottom and front edges 624, 625 cooperate to form a right included angle therebetween. In an illustrative embodiment, bottom edge 624 interconnects first chamfered edge 621 and front edge 625 and front edge 625 interconnects bottom edge 624 and second chamfered edge 622. Second anchor lug 72 has a size and shape that is similar to second anchor lug 62.

As suggested in FIG. 8, closure retainer 44 includes a first set of rail sections 101-109 associated with first and second anchor lugs 61, 62 of first lid anchor 51 and a second set of rail sections 201-209 associated with first and second anchor lugs 71, 72 of second lid anchor 52. First set of rail sections 101-109 cooperate to form first and second lug-retainer notches 441, 442 sized to receive companion first and second anchor lugs 61, 62 as suggested in FIGS. 8 and 9. Second set of rail sections 201-209 cooperate to form third and fourth lug-retainer notches 443, 444 sized to receive companion first and second anchor lugs 71, 72 as suggested in FIGS. 8 and 9.

The first set of rail sections 101-109 includes, as suggested in FIG. 8, a generally horizontal guide rail section 101, a positively sloping first inclined guide rail section 102, a generally horizontal first notch base rail section 103, a generally vertical first notch side rail section 104, a generally horizontal first notch top rail section 105, a positively sloping second inclined guide rail section 106, a generally horizontal second notch base rail section 107, a generally vertical second notch side rail section 108, and a generally horizontal second notch top rail section 109. First notch top rail section 105 is arranged to overlie first notch base rail section 103 and cooperate with first notch base and side rail sections 103, 104 to form first lug-retainer notch 441. Second top rail section 109 is arranged to lie above second notch base rail section 107 and cooperate with second notch base and side rail sections 107, 108 to form second lug-retainer notch 442. As shown, for example, in FIG. 8, first lug-retainer notch 441 opens toward first inclined guide rail section 102 and second lug-retainer notch 442 opens toward second inclined guide rail section 106.

As suggested in FIGS. 8 and 9, first anchor lug 61 is arranged to ride on horizontal and first inclined guide rail sections 101, 102 into first lug-retainer notch 441 during rotation of closure 16 about axis of rotation 26 relative to container 12 in closure-installation direction 25 to establish the installed position of closure 16 on container 12. The downwardly facing, positively sloping first chamfered edge 611 of first anchor lug 61 is arranged to ride on first inclined guide rail section 102 and the upwardly facing, positively sloping second chamfered edge 612 is arranged to ride on an inclined face 105E of a free end of first notch top rail section 105 as suggested in FIGS. 8 and 9 during movement of first anchor lug 61 in first lug-receiver slot 161 toward first lug-retainer notch 41.

Second anchor lug 62 is arranged to ride on first notch top rail section 105 and second inclined guide rail section 106 into second lug-retainer notch 442 as suggested in FIGS. 8 and 9 during rotation of closure 16 about axis of rotation 26 relative to container 12 in closure-installation direction 25 to help establish the installed position of closure 16 on container 12. The downwardly facing, positively sloping first chamfered edge 621 of second anchor lug 62 is arranged to ride on second inclined guide rail section 106 and the upwardly facing, positively sloping second chamfered edge 622 is arranged to ride on an inclined face 109E of a free end of second notch top rail section 109 as suggested in FIGS. 8 and 9 during movement of second anchor lug 62 in second lug-receiver slot 162 toward second lug-receiver notch 42.

The second set of rail sections 201-209 includes, as suggested in FIG. 8, a generally horizontal guide rail section 201, a positively sloping first inclined guide rail section 202, a generally horizontal first notch base rail section 203, a generally vertical first notch side rail section 204, a generally horizontal first notch top rail section 205, a positively sloping second inclined guide rail section 206, a generally horizontal second notch base rail section 207, a generally vertical second notch side rail section 208, and a generally horizontal second notch top rail section 209. First notch top rail section 205 is arranged to overlie first notch base rail section 203 and cooperate with first notch base and side rail sections 203, 204 to form third lug-retainer notch 443. Second top rail section 209 is arranged to lie above second notch base rail section 207 and cooperate with second notch base and side rail sections 207, 208 to form fourth lug-retainer notch 444. As shown, for example, in FIG. 8, third lug-retainer notch 443 opens toward first inclined guide rail section 202 and fourth lug-retainer notch 444 opens toward second inclined guide rail section 206.

As suggested in FIGS. 8 and 9, first anchor lug 71 is arranged to ride on horizontal and first inclined guide rail sections 201, 202 into third lug-retainer notch 443 during rotation of closure 16 about axis of rotation 26 relative to container 12 in closure-installation direction 25 to establish the installed position of closure 16 on container 12. Second anchor lug 72 is arranged to ride on first notch top rail section 205 and second inclined guide rail section 206 into fourth lug-retainer notch 444 as suggested in FIGS. 8 and 9 during rotation of closure 16 about axis of rotation 26 relative to container 12 in closure-installation direction 25 to help establish the installed position of closure 16 on container 12.

First lock tab 21 of child-resistant closure-release control mechanism 20 is coupled to an interior surface of first tab-mover wall 501 as shown, for example, in FIG. 3. First lock tab 21 lies in interior region 54 of lid 50 and is not visible to an observer when closure 16 is mounted on container 12 as shown in FIG. 1.

First lock tab 21 includes a downwardly extending plate 211 cantilevered to first tab-mover wall 501 and a pair of plate buttresses 212, 213 coupled to plate 211 and to wall 501 and arranged to lie in spaced-apart relation to one another as shown, for example, in FIG. 3. Plate 211 of first lock tab 21 is arranged to extend into lock-tab receiver channel 24 and mate with stationary tab blocker 28 and tab-motion limiter strip 29 when closure 16 is mounted on container 12 as shown best in FIGS. 1, 7, and 8.

A second lock tab 22 is coupled to closure 16 in an illustrative embodiment as shown best in FIG. 3. Second lock tab 22 is coupled to an interior surface of second tab-mover wall 502, arranged to lie in interior region 54 of lid 50, and configured to be the mirror image of first lock tab 21 as suggested in FIG. 3.

Second lock tab 22 includes a plate 221 similar to plate 211 of first lock tab 21 as shown in FIGS. 2 and 8-10. Second lock tab 22 mates and interacts with a second tab controller 32 coupled to filler neck 40 of container 12 as suggested in FIGS. 2 and 8 in the same way that first lock tab 22 mates and interacts with first tab controller 31. Second lock tab 22 also includes two plate buttresses 222, 223 as shown in FIG. 3.

Installation of closure 16 on container 12 is shown, for example, in FIGS. 2 and 5-7. During such installation, plate 211 of first lock tab 21 is moved into lock-tab receiver channel 24 as suggested in FIGS. 4, 5, and 6 and is aligned with stationary tab blocker 28 and tab-motion limiter strip 29 as suggested in FIG. 7. Tab-motion limiter strip 29 provides means for limiting radially outward motion of first lock tab 21 away from axis 26 when closure 16 is mounted on container 12. Similarly, during such closure installation, plate 221 of second lock tab 22 is moved into a companion lock tab receiver channel (not shown) and aligned with a companion stationary tab blocker (not shown) and a companion tab-motion limiter strip (not shown).

Figure 5:
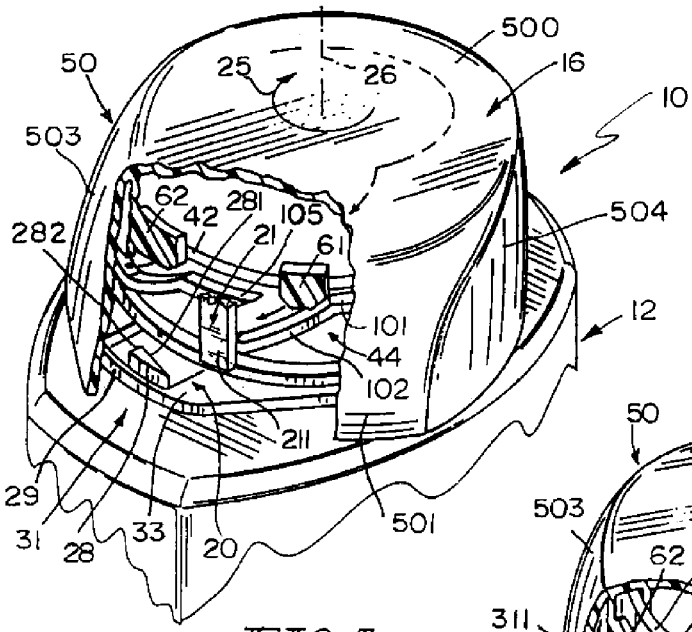
FIGS. 5-7 show, in sequence, movement of the first and second anchor lugs included in the first lid anchor on rail sections included in a closure retainer coupled to the rim of the filler neck of the container and into separate first and second lug-retainer notches defined by rail sections in the closure retainer during installation of the closure on the container.

First lock tab 21 is moved downwardly toward stationary tab blocker 28 coupled to a horizontal tab-blocker support platform 33 included in closure-release control mechanism 20 as closure 16 is rotated in a clockwise direction 25 about a vertical axis of rotation 26 toward an installed position on container 12 is shown, for example, in FIG. 5. Further downward movement of first lock tab 21 into lock-tab receiver channel 24 formed in tab-blocker support platform 33 coupled to container 12 is shown, for example, in FIG. 6. Deployment of first lock tab 21 in lock-tab receiver channel 24 to cause an end wall of first lock tab 21 to mate with a stop face 282 included in the tab blocker 28 and a relatively longer outer side wall of first lock tab 21 to mate with tab-motion limiter strip 29 included in tab-blocker support platform 33 and configured to provide means for blocking movement of first lock tab 21 in a radially outward direction away from the axis of rotation 26 of closure 16 while closure 16 is installed on container 12 and first lock tab 21 is arranged to lie in confronting relation to stop face 282 included in the tab blocker 28.

During removal of closure 16 from container 12, plate 111 of first lock tab 21 is moved in lock-tab receiver channel 24 to disengage stationary tab blocker 28 and tab-motion limiter strip 29. Similarly, plate 221 of second lock tab 22 is moved in the companion lock-tab receiver channel to disengage the companion stationary tab blocker and the companion tab-motion limiter strip. Now closure 16 is free to rotate in a counterclockwise closure-removal direction 27 to separate closure 16 from container 12.

A user is applying squeezing forces (represented in FIG. 1 by opposing arrows 34) to the two bowed tab-mover walls 501, 502 included in lid 50 to move each of first and second lock tabs 21, 22 radially inwardly. Such movement causes each of those lock tabs 21, 22 to separate from a companion tab-motion limiter strip and a stop 282 of a companion triangle-shaped tab-motion blocker to free closure 16 so it can be rotated in a counterclockwise closure-removal direction 36 relative to container 12.

Closure 16 includes a deformable lid 50 formed to include an interior region 54 as suggested in FIGS. 2 and 3. First lock tab 21 is coupled to deformable lid 50 and arranged to lie in interior region 54 as shown in FIGS. 2 and 3. First lock tab 21 is arranged to move in lock tab receiver channel 24 from the closure-retaining position shown in FIG. 7 in a radially inward direction 130 toward axis of rotation 26 and away from tab-motion limiter 29 during inward deformation of deformable lid 50 to assume a radially inwardly displaced closure-releasing position in lock-tab receiver channel 24 closer to axis of rotation 26. This inward movement is in response to application of an external force 34 to an exterior portion of deformable lid 50 associated with first lock tab 21 and causes separation of first lock tab 21 from tab blocker 28 to initiate removal of closure 16 from container 12. Such separation frees closure 16 to rotate relative to container 12 about axis of rotation 26 in closure-removal direction 36 in an authorized effort to remove closure 16 from container 12.

During installation of closure 16 on container 12, as suggested in FIGS. 5-7, first lock tab 21 of closure-release control mechanism 20 is moved into a lock-tab receiver channel 24 formed in first tab controller 31 of closure-release control mechanism 20 as closure 16 is rotated about axis of rotation 26 in a clockwise closure-installation direction 25 relative to the underlying container 12. A stationary tab blocker 28 included in first tab controller 31 is arranged normally to block rotation of closure 16 in a counterclockwise closure-removal direction 27 about axis 16 relative to container 12 as suggested in FIG. 7.

First tab controller 31 is coupled to an exterior surface 43 of rim 42 of filler neck 40 of container 12 in an illustrative embodiment of the present disclosure as suggested in FIGS. 2 and 5-7. First tab controller 31 is positioned to lie below closure retainer 44 on rim 42 and above a top wall 46 of body 38 of container 12 as shown best in FIG. 2.

First tab controller 31 includes stationary tab blocker 28 and tab-motion limiter strip 29 as suggested in FIGS. 2 and 5-7. In an illustrative embodiment, first tab controller 31 includes a tab-blocker support platform 33 coupled to rim 42 of filler neck 40 as shown in FIG. 2. Platform 33 includes tab-motion limiter strip 29 and has a generally trapezoidal shape in the illustrated embodiment and is formed to include a generally L-shaped lock-tab receiver channel 24 as suggested in FIGS. 2 and 5-7. Tab blocker 28 is arranged to define an outer boundary of lock-tab receiver channel 24 in an illustrative embodiment as shown, for example, in FIG. 2.

Tab blocker 28 includes a cam ramp 281 and a stop face 282 as suggested in FIG. 2. Tab blocker 28 is coupled to tab blocker support platform 33 to lie in a stationary position to intercept and/or mate with plate 211 of first lock tab 21 as first lock tab 21 moves in or near lock-tab receiver channel 24 as suggested in FIGS. 5-7. Cam ramp 281 is configured to provide means for contacting plate 211 as plate 211 moves downwardly into lock-tab receiver channel 24 during installation of closure 16 on container 12 and for yieldably biasing plate 211 in a radially inward direction until plate 211 clears tab blocker 28. Once cleared, the elastic plate 211 of first lock tab 21 snaps or moves in an opposite radially outward direction to assume a locked position shown, for example, in FIG. 7 in which an edge of plate 211 lies in closely confronting relation to stop face 282 of tab blocker 28. Stop face 282 is configured to provide means for mating with the edge of plate 211 when closure 16 is mounted on container 12 to block movement of closure 16 about axis 26 relative to container 12 in counterclockwise closure-removal direction 27 as suggested in FIG. 7.

In an illustrative embodiment, first tab controller 31 is a monolithic element appended to rim 42 of filler neck 42. In an illustrative embodiment, first tab controller 31 and rim 42 cooperate to form a monolithic element as suggested in FIG. 2.

The invention claimed is:

1. A canister comprising a container formed to include a product-receiving chamber and a mouth opening into the product-receiving chamber and a closure configured to mount on the container to assume an installed position closing the mouth formed in the container when rotated relative to the container about an axis of rotation, wherein the closure includes a lid having a top wall and a skirt coupled to the top wall and configured to cooperate with the top wall to form an interior region of the lid, the closure further includes a first lid anchor coupled to the top wall and arranged to lie in spaced-apart relation to the skirt, the container includes a body formed to include the product-receiving chamber and a filler neck coupled to the body and formed to include a passageway communicating with the mouth and the product-receiving chamber, a rim, and a closure retainer coupled to an exterior surface of the rim to lie outside the passageway and configured to mate with the first lid anchor to retain the closure in the installed position on the container, wherein the lid further includes a second lid anchor coupled to the top wall and arranged to lie in spaced-apart relation to the skirt and to the first lid anchor to locate the rim of the filler neck therebetween and to mate with the closure retainer when the closure is retained in the installed position on the container, and wherein the first lid anchor includes a first lug support coupled to the top wall and arranged to extend downwardly away from the top wall toward the body of the container and a first anchor lug coupled to the first lug support and arranged to extend toward the rim to mate with the closure retainer upon movement of the closure to assume the installed position on the container and the second lid anchor includes a second lug support coupled to the top wall and arranged to extend downwardly away from the top wall toward the body of the container and a second anchor lug coupled to the second lug support and arranged to extend toward the rim to mate with the closure retainer upon movement of the closure to assume the installed position on the container.

2. The canister of claim 1, wherein each of the first and second lid anchors further include a second anchor lug, the second anchor lug of the first lid anchor is coupled to the first lug support and arranged to extend toward the rim to mate with the closure retainer upon movement of the closure to assume the installed position, and the second anchor lug of the second lid anchor is coupled to the second lug support and arranged to extend toward the rim to mate with the closure retainer upon movement of the closure to assume the installed position.

3. The canister of claim 1, wherein each of the first and second lug supports includes a concave surface arranged to face toward the rim, the first anchor lug of the first lid anchor is coupled to the concave surface of the first lug support, and the first anchor lug of the second lid anchor is coupled to the concave surface of the second lug support.

4. The canister of claim 1, wherein the closure further includes a ring-shaped orientation member coupled to the top wall of the lid and arranged to lie in the interior region of the lid to mate with the rim when the closure lies in the installed position on the container to orient the lid in a predetermined aligned relation with the container and the ring-shaped orientation member is arranged to lie between the first and second lug supports.

5. A canister comprising a container formed to include a product-receiving chamber and a mouth opening into the product-receiving chamber and a closure configured to mount on of the container to assume an installed position closing the mouth formed in the container when rotated relative to the container about an axis of rotation, wherein the closure includes a lid having a top wall and a skirt coupled to the top wall and configured to cooperate with the top wall to form an interior region of the lid, the closure further includes a first lid anchor coupled to the top wall and arranged to lie in spaced-apart relation to the skirt, the container includes a body formed to include the product-receiving chamber and a filler neck coupled to the body and formed to include a passageway communicating with the mouth and the product-receiving chamber, a rim, and a closure retainer coupled to an exterior surface of the rim to lie outside the passageway and configured to mate with the first lid anchor to retain the closure in the installed position on the container, wherein the lid further includes a second lid anchor coupled to the top wall and arranged to lie in spaced-apart relation to the skirt and to the first lid anchor to locate the rim of the filler neck therebetween and to mate with the closure retainer when the closure is retained in the installed position on the container, and wherein the skirt includes a first side wall and a second side wall located in spaced-apart relation to the first side wall to locate the first and second lid anchors therebetween, the first lid anchor is arranged to lie in spaced-apart relation to the first and second side walls and between the first side wall and the second lid anchor, and the second lid anchor is arranged to lie in spaced-apart relation to the first and second side walls and between the first lid anchor and the second side wall.

6. The canister of claim 5, wherein the closure further includes a ring-shaped orientation member coupled to the top wall of the lid and arranged to lie in the interior region of the lid to mate with the rim when the closure lies in the installed position on the container to orient the lid in a predetermined aligned relation with the container and the ring-shaped orientation member is arranged to lie between the first and second lug supports.

7. A canister comprising a container formed to include a product-receiving chamber and a mouth opening into the product-receiving chamber and a closure configured to mount on of the container to assume an installed position closing the mouth formed in the container when rotated relative to the container about an axis of rotation, wherein the closure includes a lid having a top wall and a skirt coupled to the top wall and configured to cooperate with the top wall to form an interior region of the lid, the closure further includes a first lid anchor coupled to the top wall and arranged to lie in spaced-apart relation to the skirt, the container includes a body formed to include the product-receiving chamber and a filler neck coupled to the body and formed to include a passageway communicating with the mouth and the product-receiving chamber, a rim, and a closure retainer coupled to an exterior surface of the rim to lie outside the passageway and configured to mate with the first lid anchor to retain the closure in the installed position on the container, wherein the lid further includes a second lid anchor coupled to the top wall and arranged to lie in spaced-apart relation to the skirt and to the first lid anchor to locate the rim of the filler neck therebetween and to mate with the closure retainer when the closure is retained in the installed position on the container, and wherein the closure retainer includes a first set of rail sections associated with the first lid anchor and coupled to the exterior surface of the rim and a second set of rail sections associated with the second lid anchor and coupled to the exterior surface of the rim, each set of rail sections includes, in series, a generally horizontal guide rail section, a positively sloping first inclined guide rail section, a generally horizontal first notch base rail section, a generally vertical first notch side rail section, and a generally horizontal first notch top rail section arranged to overlie the first notch base rail section and cooperate with the first notch side and base rail sections to form a first lug-retainer notch opening toward the first inclined guide rail section, the first lid anchor includes a first anchor lug that is arranged to ride on the horizontal and first inclined guide rail sections of the first set of rail sections into the first lug-retainer notch formed by the first set of rail sections during rotation of the closure about the axis of rotation relative to the container to cause the first lid anchor to mate with the closure retainer to establish the installed position of the closure on the container, and the second lid anchor includes a first anchor lug that is arranged to ride on the horizontal and first inclined guide rails of the second set of rail sections into the first lug-retainer notch formed by the second set of rail sections during rotation of the closure about the axis of rotation relative to the container to cause the second lid anchor to mate with the closure retainer also to establish the installed position of the closure on the container.

8. The canister of claim 7, wherein each set of rail sections further includes, in series, a positively sloping second inclined guide rail section, a generally horizontal second notch base rail section, a generally vertical second notch side rail section, and a generally horizontal second notch top rail section arranged to overlie the second notch base rail section and cooperate with the second notch base and side rail sections to form a second lug-retainer notch opening toward the second inclined guide rail section, the first lid anchor further includes a second anchor lug that is arranged to ride on the first notch top rail section and the second inclined guide rail section of the first set of rail sections into the second lug-retainer notch formed by the first set of rail sections during rotation of the closure about the axis of rotation relative to the container when the first anchor lug of the first lid anchor moves into the first lug-retainer notch formed by the first set of rail sections, and the second lid anchor further includes a second anchor lug that is arranged to ride on the first notch top rail section and the second inclined guide rail section of the second set of rail sections into the second lug-retainer notch formed by the second set of rail sections during rotation of the closure about the axis of rotation relative to the container when the first anchor lug of the second lid anchor moves into the first lug-retainer notch formed by the second set of rail sections.

9. The canister of claim 8, wherein the guide rail section in the first set of rail sections is coupled to the second notch top rail section in the second set of rail sections and the guide rail section in the second set of rail sections is coupled to the second notch top rail section in the first set of rail sections.

10. The canister of claim 8, wherein the first lid anchor further includes a first lug support coupled to the top wall and arranged to extend downwardly away from the top wall toward the body of the container, the first and second anchor lugs of the first lid anchor are coupled to the first lug support and arranged to lie in side-by-side spaced-apart relation to one another on the first lug support, the second lid anchor further includes a second lug support coupled to the top wall and arranged to extend downwardly away from the top wall toward the body of the container, and the first and second anchor lugs of the second lid anchor are coupled to the second lug support and arranged to lie in side-by-side spaced-apart relation to one another on the second lug support.

11. A canister comprising a container formed to include a product-receiving chamber and a mouth opening into the product-receiving chamber and a closure configured to mount on of the container to assume an installed position closing the mouth formed in the container when rotated relative to the container about an axis of rotation, wherein the closure includes a lid having a top wall and a skirt coupled to the top wall and configured to cooperate with the top wall to form an interior region of the lid, the closure further includes a first lid anchor coupled to the top wall and arranged to lie in spaced-apart relation to the skirt, the container includes a body formed to include the product-receiving chamber and a filler neck coupled to the body and formed to include a passageway communicating with the mouth and the product-receiving chamber, a rim, and a closure retainer coupled to an exterior surface of the rim to lie outside the passageway and configured to mate with the first lid anchor to retain the closure in the installed position on the container, wherein the first lid anchor includes a first lug support coupled to the top wall and a first anchor lug coupled to the first lug support and arranged to extend toward the axis of rotation to fit into a first lug-retainer notch formed in the closure retainer when the closure is retained in the installed position on the container.

12. The canister of claim 11, wherein the first lid anchor also includes a second anchor lug coupled to the first lug support and arranged to lie in spaced-apart relation to the first anchor lug and fit into a second lug-retainer notch formed in the closure retainer when the closure is retained in the installed position on the container.

13. The canister of claim 12, wherein the closure retainer is formed to include a second inclined lug-receiver slot located between the first and second lug-retainer notches and configured to provide means for guiding the second anchor lug along one inclined path into the second lug-retainer notch during rotation of the closure about the axis of rotation in a closure-installation direction toward the installed position on the container and the closure retainer is formed to include a first inclined lug-receiver slot arranged to lie in spaced-apart relation to the second inclined lug-receiver slot and configured to provide means for guiding the first anchor lug along another inclined path into the first lug-retainer notch during rotation of the closure about the axis of rotation in the closure-installation direction.

14. The canister of claim 13, wherein the first anchor lug has a first shape characterized by a first length, the second anchor lug has a second shape characterized by a relatively longer second length, and the closure retainer is formed to include a first lug-entry port opening into the first inclined lug-receiver slot and the first lug-entry port is sized to provide means for allowing passage of the first anchor lug therethrough and for blocking passage of the second anchor lug therethrough during rotation of the closure about the axis of rotation relative to the container so that the first anchor lug is able to pass through the first lug-entry port and into the first inclined lug-receiver slot to reach the first lug-retainer notch and the second anchor lug is blocked from passing through the first lug-entry port and allowed to pass through the second lug-entry port and through the second-inclined lug-receiver slot to reach the second lug-retainer notch.

15. The canister of claim 11, wherein the closure retainer includes a first set of rail sections associated with the first lid anchor and coupled to the exterior surface of the rim, the first set of rail sections includes in series, a generally horizontal guide rail section, a positively sloping first inclined guide rail section, a generally horizontal first notch base rail section, a generally vertical first notch side rail section, and a generally horizontal first notch top rail section arranged to overlie the first notch base rail section and cooperate with the first notch side and base rail sections to form a first lug-retainer notch opening toward the first inclined guide rail section, the first anchor lug is arranged to ride on the horizontal and first inclined guide rail sections of the first set of rail sections into the first lug-retainer notch during rotation of the closure about the axis of rotation relative to the container to cause the first lid anchor to mate with the closure retainer to establish the installed position of the closure on the container.

16. The canister of claim 15, wherein the first set of rail sections further includes, in series, a positively sloping second inclined guide rail section, a generally horizontal second notch base rail section, a generally vertical second notch side rail section, and a generally horizontal second notch top rail section arranged to overlie the second notch base rail section and cooperate with the second notch base and side rail sections to form a second lug-retainer notch opening toward the second inclined guide rail section, and the first lid anchor further includes a second anchor lug that is arranged to ride on the first notch top rail section and the second inclined guide rail section of the first set of rail sections into the second lug-retainer notch formed by the first set of rail sections during rotation of the closure about the axis of rotation relative to the container when the first anchor lug of the first lid anchor moves into the first lug-retainer notch formed by the first set of rail sections.

17. The canister of claim 15, wherein a free end of the first notch top rail section and the first inclined guide rail section cooperate to provide therebetween a first lug-receiver slot communicating with the first lug-retainer notch.

18. The canister of claim 17, wherein the free end of the first notch top rail section includes an inclined face that is arranged to lie in substantially spaced-apart parallel relation to the first inclined guide rail section and the first anchor lug includes a downwardly facing, positively sloping first chamfered edge arranged to ride on the first inclined guide rail section and an upwardly facing, positively sloping second chamfered edge arranged to ride on the inclined face of the free end of the first notch top rail section during movement of the first anchor lug in the first lug-receiver slot toward the first lug-retainer notch.

19. The canister of claim 18, wherein the first anchor lug further includes an exterior surface interconnecting the first and second chamfered edges and comprising a bottom edge arranged to mate with the first notch base rail section when the first anchor lug lies in the first lug-retainer notch and a front edge arranged to mate with the first notch side rail section when the first anchor lug lies in the first lug-retainer notch.

20. A canister comprising a container forming a product-receiving chamber and a mouth opening into the product-receiving chamber, the container including a body and a filler neck including a rim extending from the body and a closure retainer coupled to an exterior surface of the rim, and a closure configured to mount on the container to assume an installed position closing the mouth formed in the container, the closure including a lid having a top wall, a skirt coupled to the top wall and configured to cooperate with the top wall to form an interior region of the lid, a first lid anchor coupled to the top wall and arranged to lie in spaced-apart relation to the skirt, and a second lid anchor coupled to the top wall and arranged to lie in spaced-apart relation to the skirt and to the first lid anchor to locate the rim of the filler neck therebetween, wherein the first lid anchor includes a first lug support coupled to the top wall and arranged to extend downwardly away from the top wall toward the body of the container and a first anchor lug coupled to the first lug support and arranged to extend toward the rim to mate with the closure retainer and the second lid anchor includes a second lug support coupled to the top wall and arranged to extend downwardly away from the top wall toward the body of the container and a second anchor lug coupled to the second lug support and arranged to extend toward the rim to mate with the closure retainer.

* * * * *